United States Patent [19]

Takenaka et al.

[11] Patent Number: 4,626,737

[45] Date of Patent: Dec. 2, 1986

[54] MASK FOCUSING COLOR PICTURE TUBE

[75] Inventors: Shigeo Takenaka, Fukaya; Eizaburo Hamano, Kumagaya; Eiji Kamohara, Fukaya, all of Japan

[73] Assignee: Tokyo Shibaura Denki Kabushiki Kaisha, Kawasaki, Japan

[21] Appl. No.: 685,230

[22] Filed: Dec. 27, 1984

Related U.S. Application Data

[63] Continuation of Ser. No. 351,882, Feb. 24, 1982, abandoned.

[30] Foreign Application Priority Data

Feb. 25, 1981 [JP] Japan ..... 56-25448

[51] Int. Cl.[4] ..... H01J 29/81

[52] U.S. Cl. ..... 313/402; 313/408

[58] Field of Search ..... 313/402, 403, 407, 408

[56] References Cited

U.S. PATENT DOCUMENTS 3,574,013 4/1971 Frantzen ..... 313/402 X
4,066,923 1/1978 van Esdonk ..... 313/402
4,300,069 11/1981 Nolan ..... 313/403
4,392,914 7/1983 Takenaka et al. ..... 313/402 X
4,427,918 1/1984 Lipp ..... 313/402
4,503,355 3/1985 Kamohara ..... 313/408 X

*Primary Examiner*—Palmer C. DeMeo
*Assistant Examiner*—Sandra L. O'Shea
*Attorney, Agent, or Firm*—Finnegan, Henderson, Farabow, Garrett & Dunner

[57] ABSTRACT

A mask-focusing color picture tube comprising an evacuated envelope; means to generate a number of electron beams; a display screen comprising a large number of phosphor stripes luminescing in different colors; a plurality of masks being spaced in the predetermined distance each other, individually having a number of apertures which is arranged in rows and being disposed in the vicinity of said screen, each electron beam being assigned to phosphor stripe of a respective color through said corresponding mask aperture, the improvement comprising, at least one of said plurality of masks having a plurality of projections on at least one side of said mask, said projections being separated each other by the rows of said apertures.

11 Claims, 12 Drawing Figures

MASK FOCUSING COLOR PICTURE TUBE

This application is a continuation, of application Ser. No. 351,882, filed Feb. 24, 1982, and now abandoned.

BACKGROUND OF THE INVENTION

This invention relates to a mask-focusing color picture tube using a plurality of shadow masks electrically insulated from and facing one another, these shadow masks being disposed in the vicinity of the phosphor screen and acting to form an electrostatic lens for electron beams, and more particularly, to the structure of shadow masks in such a picture tube.

In the usual color picture tube provided with a shadow mask, the brightness of the screen is limited because the electron beam utility factor is as low as about 20% due to the presence of the shadow mask. The most effective method of improving the brightness is to increase the electron beam utility factor by increasing the shadow mask aperture diameter and mask-focusing the electron beams. To realize this, there has been proposed a mask-focusing color picture tube, in which an electrostatic lens is formed near the phosphor screen, as disclosed in U.S. Pat. Nos. 3,016,474, 2,971,117, 3,398,309 and 4,112,563 and Japanese patent disclosure Nos. 79969/1973, 8261/1972 and 24652/1980.

Among these mask-focusing picture tubes, those which use a single shadow mask require that a voltage applied to a metal-backed phosphor screen must be much higher than a voltage applied to the shadow mask. Therefore, secondary electrons generated from the shadow mask are accelerated to impinge upon the screen, thus reducing the clarity of image and lowering the contrast, which is undesired in practice.

On the other hand, those mask-focusing picture tubes which use a plurality of shadow masks all have peculiar disadvantages, for example, weak focusing power due to their simple mask aperture lens. It is necessary to set a considerably high potential difference between the shadow masks, thus giving rise to serious arcing problems between shadow masks. In a mask-focusing picture tube where a quadrupole lens is formed as electrostatic lens in the shadow mask apertures, the focusing power in one direction is greatly increased. In this tube, however, the shadow mask has a grill-like structure. The grill-like mask is inferior in mechanical strength and moldability and is therefore undesired in view of the practical use.

SUMMARY OF THE INVENTION

An object of the invention is to provide a mask-focusing color picture tube having a plurality of shadow masks electrically insulated from one another, which has sufficient mechanical strength and moldability of the masks and permits increasing the focusing power of an electrostatic lens formed in the masks to thereby reduce the inter-mask potential difference for improving the breakdown voltage.

According to the invention, there is provided a mask-focusing color picture tube having a plurality of shadow masks individually having a number of apertures, in which at least one of the shadow masks has at least on one side a number of projections in the proximity of the apertures.

DETAILED DESCRIPTION OF THE PREFERRED EMBODIMENTS

Now, the invention will be described in detail with reference to the drawings.

Figure 1:
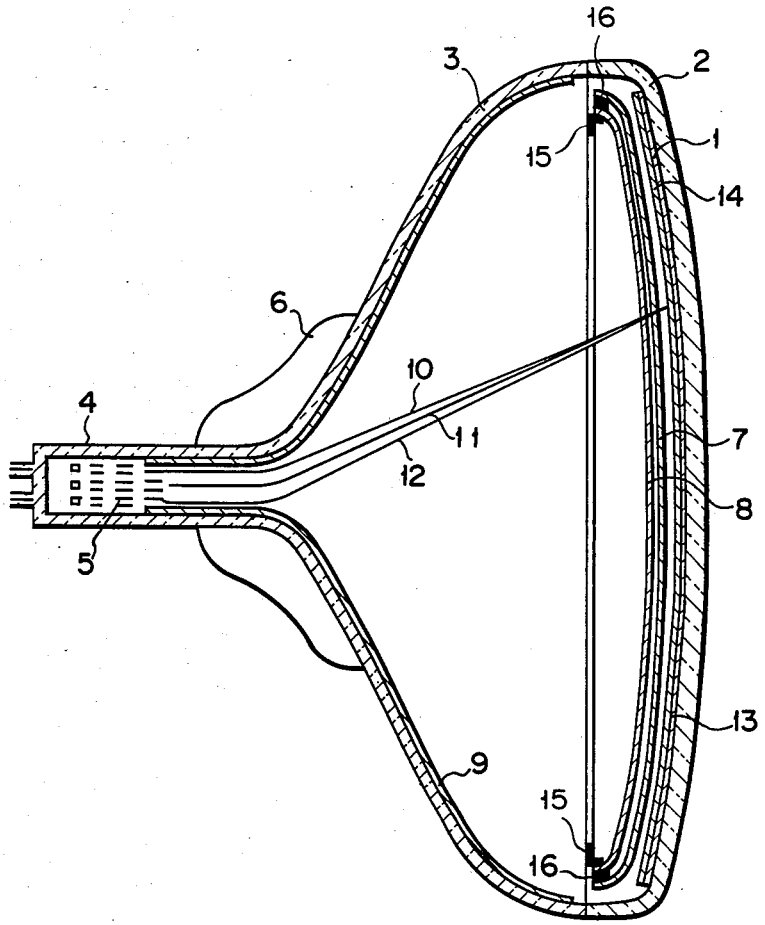
FIG. 1 is a sectional view showing a mask-focusing color picture tube according to the invention.

FIG. 1 outlines an example of the construction of the mask-focusing color picture tube according to the invention. The illustrated mask-focusing color picture tube comprises a face plate 2 having a metal-backed phosphor screen 1, a neck 4 coupled via a funnel 3 to the side wall of the face plate 2, an electron gun assembly 5 accommodated in the neck 4, a deflecting unit 6 mounted on the outer wall of the tube extending from neck 4 to funnel 3, a mask 7 disposed in the vicinity of the screen 1 at a predetermined distance therefrom, a mask 8 disposed on the side of the mask 7 nearer the electron gun assembly 5 and at a predetermined distance from the mask 7, and a conductive coating 9 uniformly coated on the inner wall of the tube including the funnel and a portion of the neck 4. The mask 8 is supported in the face plate 2 by the mask frame 15 and other supporting members (not shown). The mask 7 is supported by the mask 8 via insulating means 16 in the peripheral portion of the masks 7, 8.

Three electron beams 10, 11 and 12 generated from the electron gun assembly 5 are deflected by the deflecting unit 6 and selected and focused by the masks 8 and 7 to reach the screen 1. A metal backing layer 14 is provided on the phosphors 13 for the purposes of providing the screen voltage. The potential of the phosphor screen and the metal layer 14 is hereinafter referred to as screen potential. The potentials of the screen 1, conductive coating 9, and masks 7 and 8, can be supplied through some anode contacts (not shown) provided on the funnel.

The screen 1 consists of phosphors 13 for three colors provided in the form of stripes to correspond to the three electron beams such that those phosphors which are bombarded by the electron beams emit light.

Figure 2A:
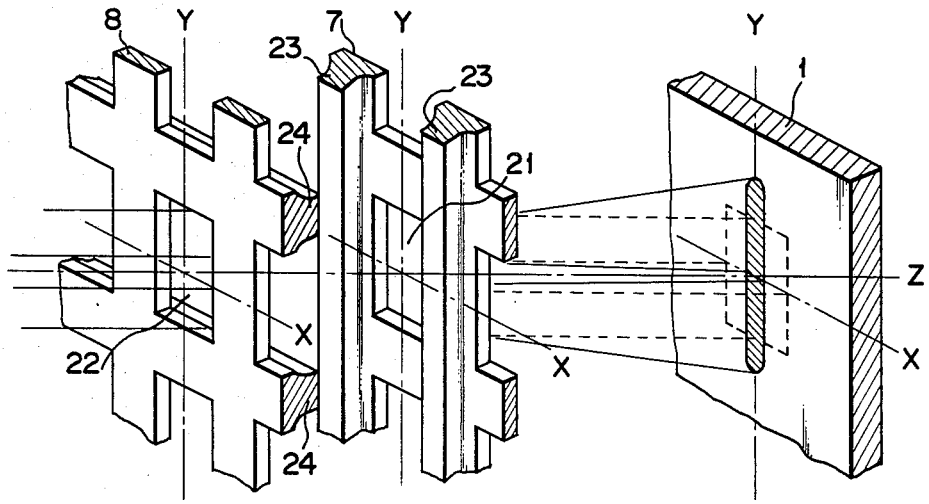
FIG. 2A is a fragmentary enlarged-scale perspective view showing a shadow mask and screen structure in one embodiment of the invention.
Figure 2B:
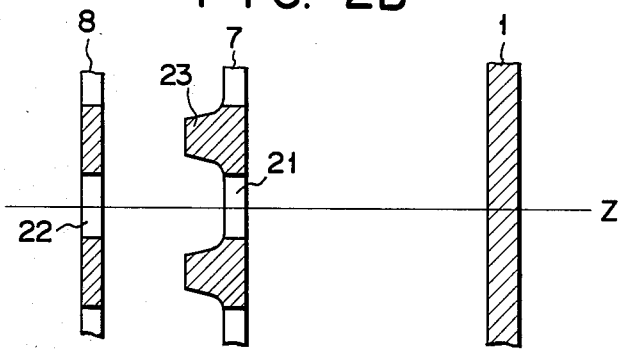
FIG. 2B is a sectional view taken along X–Z plane in FIG. 2A.
Figure 2C:
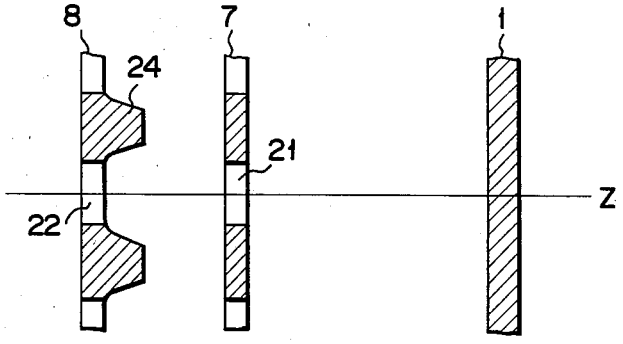
FIG. 2C is a sectional view taken along Y–Z plane in FIG. 2A.

FIG. 2A shows in an fragmentary enlarged-scale view the screen 1 and masks 7 and 8, as well as showing the manner in which the electron beams are focused. FIGS. 2B and 2C are sectional views taken along X–Z and Y–Z planes in FIG. 2A respectively. In these FIGS. 2A to 2C the phosphor stripes for the three colors on the screen 1 are not illustrated.

The highest voltage is applied to the metal layer 14, the conductive coating 9 and the electron gun side mask 8, and the lower voltage is applied to the screen side mask 7.

Figure 3A:
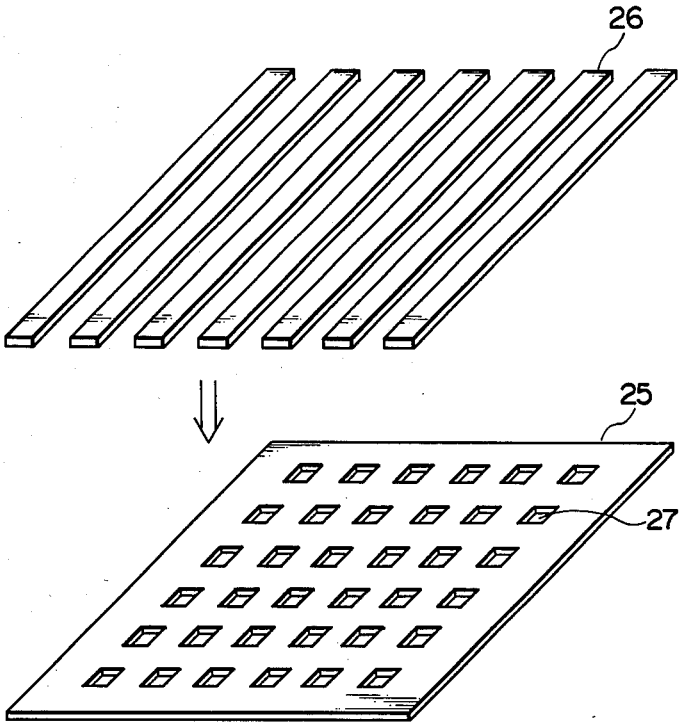
FIG. 3A is a view illustrating an example of manufacture of a shadow mask according to the invention.
Figure 3B:
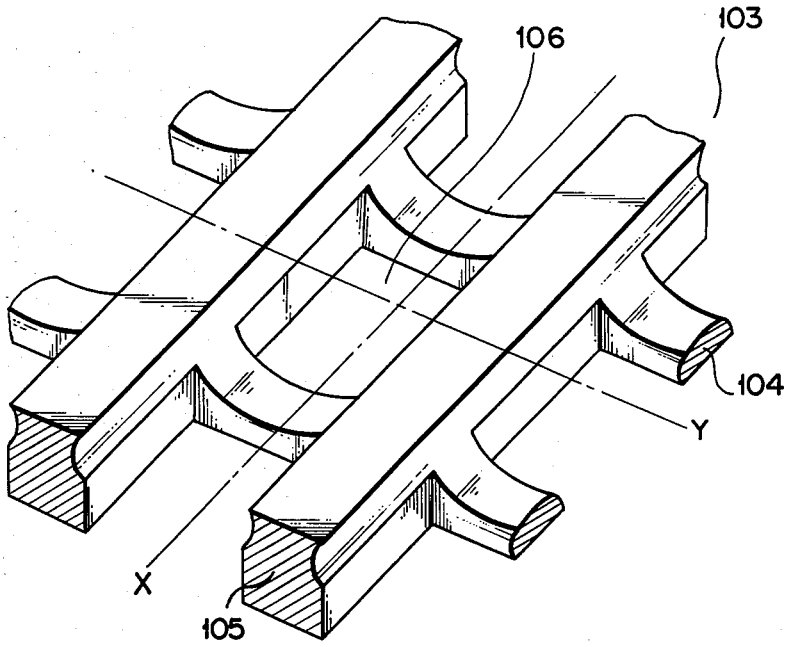
FIG. 3B is a fragmentary enlaged-scale perspective view showing a modification of projections formed on shadow masks according to the invention.

The screen side and electron gun side masks 7 and 8 shown in FIG. 2A have many rectangular apertures 21 and 22. The screen side mask 7 has on its side facing the electron gun side mask 8 elongate projections 23. Each projection 23 extends in the direction of Y axis, substantially parallel to the phosphor stripes. The apertures 21 locate between two adjacent projections 23. On the other hand, the electron gun side shadow mask 8 has on its side facing the screen side mask 7 elongate projections 24. Each projection 24 extends in the direction of X axis, substantially perpendicular to the phosphor stripes. The apertures 22 locate between two adjacent projections 24. These shadow masks having the elongate projections 23 and 24 may be readily fabricated by bonding separately prepared strip-like metal plates 26 to a mask 25 without projections such that they extend parallel to horizontal or vertical rows of apertures, as shown in FIG. 3A. They may also be fabricated by etching a thick metal plate. FIG. 3B shows a gun side mask which is manufactured by etching. The shadow mask 103 shown in FIG. 3B consists of thin portions 104 and thick portions 105 surrounding apertures 106. The thick portions 105 (projections) extends in the X axis direction.

Such a mask has a superior mechanical strength to the ordinary shadow mask used in color picture tubes due to the ridge-like projections. And, the mask formation of spherical configuration can be simply obtained with press like the ordinary shadow mask used in color picture tubes. Thus, the fabrication of the shadow mask of the present invention is far simpler to the case of a grill-like shadow mask.

When different potentials are applied to these two shadow masks 7 and 8 having the elongate projections 23 and 24 shown in FIG. 2A, an electrostatic lens having strong focusing power can be formed between the two shadow masks.

This phenomenon can be explained as follows.

With an arrangement where two ordinary shadow masks without any projection formed adjacent to the apertures are used, an electrostatic lens of the same kind as the well-known cylindrical lens is formed by the two shadow masks and metal-backed phosphor screen. With this electrostatic lens, the lines of electric force have a greater component in the direction of progress of beam (Z axis direction) than the component in the direction perpendicular to the beam progress direction.

In contrast, where shadow masks having projections formed adjacent to apertures as shown in FIGS. 2A to 2C are used, lines of electric force are formed to extend from the projections 24 on the electron gun side mask 8 to the projection 23 on the screen side mask 7. Thus, in this zone the component of the lines of electric force perpendicular to the beam progress direction is increased compared to the aforementioned case.

Figure 2D:
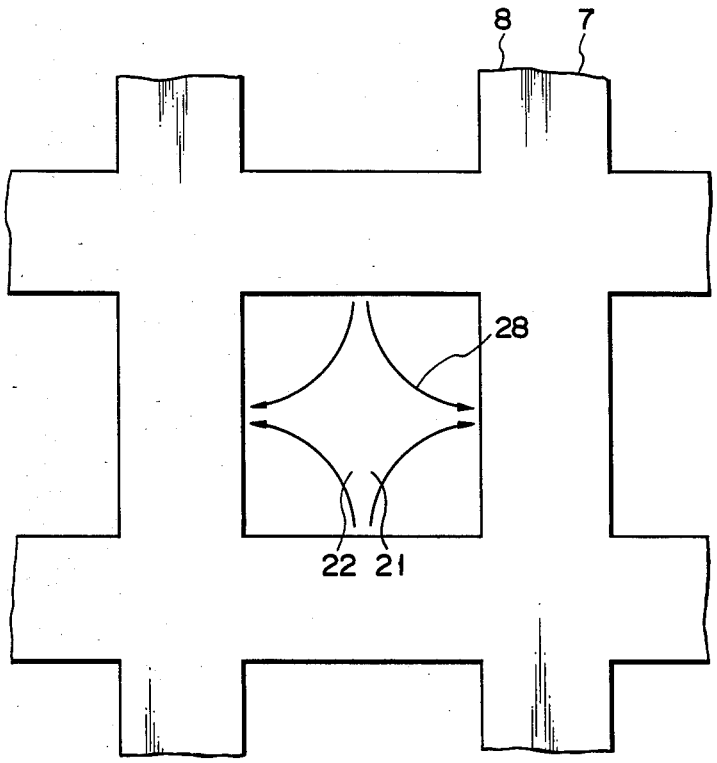
FIG. 2D shows lines of electric force in the shadow mask structure of FIG. 2A viewed from the side of the electron gun assembly.

FIG. 2D shows a portion of the mask with an aperture, viewed from the side of the electron gun assembly, and lines of electric force 28 mentioned above.

As is apparent from FIG. 2D, this lens has a focusing action in one direction and a diverging action in another direction, and is known as a quadrupole lens system.

With the projections provided on the shadow masks, the lens action to the electron beams in the direction perpendicular to the direction of the beam progress is extremely increased compared to the case using shadow masks without any projection.

The electrostatic lens formed in the present case acts as a diverging lens in the Y–Z plane as shown in FIG. 2A while acting as a focusing lens in the X–Z plane. The electron beam spots on the screen are elongated in the Y axis direction.

The electron beam spot is elongated in the Y axis direction, however, does not result in any color contamination, because the phosphor stripes extend in the direction of Y axis.

In the case of the above embodiment, the specifications of the mask structure may be as follows.

With both the shadow masks the thickness of the thin portion is 0.1 mm, the thickness of the thick portion, i.e., the projection adjacent to apertures, is 0.3 mm, the aperture size in both the X and Y axis directions is 0.50 mm, the aperture pitch in both the X and Y axis directions is 0.75 mm, the distance between the two masks is 0.5 mm, the distance between mask and screen is about 13.5 mm, the screen voltage and electron gun assembly side mask voltage is 25 kV, and the screen side mask voltage is 23 kV.

In this case, the electron beam spot formed on the screen has dimensions of about 0.25 mm in the X axis direction and 0.72 mm in the Y axis direction.

On the other hand, in the case of a two-mask structure using ordinary flat shadow masks without any projection adjacent to apertures, with an aperture diameter of 0.50 mm in the direction of X axis, an aperture pitch of 0.75 mm, an inter-mask distance of 0.5 mm and a mask-to-screen distance of about 13.5 mm, it is necessary to apply 25 kV as the screen voltage and electron gun side mask voltage and about 19 kV as the screen side mask voltage in order to obtain an electron beam spot diameter of about 0.25 mm on the screen.

It will be understood that by the provision of the aforementioned projections adjacent to the shadow mask apertures, the inter-mask potential difference can be reduced from 6 kV to 2 kV, so that it is possible to reduce the inter-mask average electric field intensity from 12 kV/mm to 4 kV/mm, only one-third.

While in the above embodiment elongate or parallel ridge-like projections were formed adjacent to or near the apertures, this is by no means limitative.

Figure 7A:
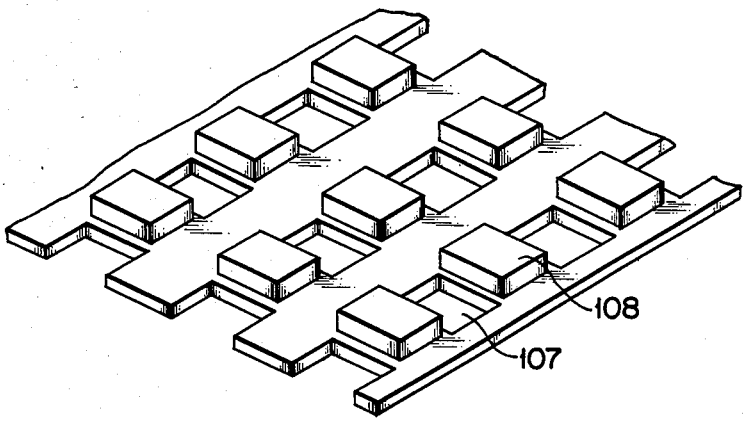
FIG. 7A is a fragmentary perspective view showing another modification of projections formed on masks according to the invention.
Figure 7B:
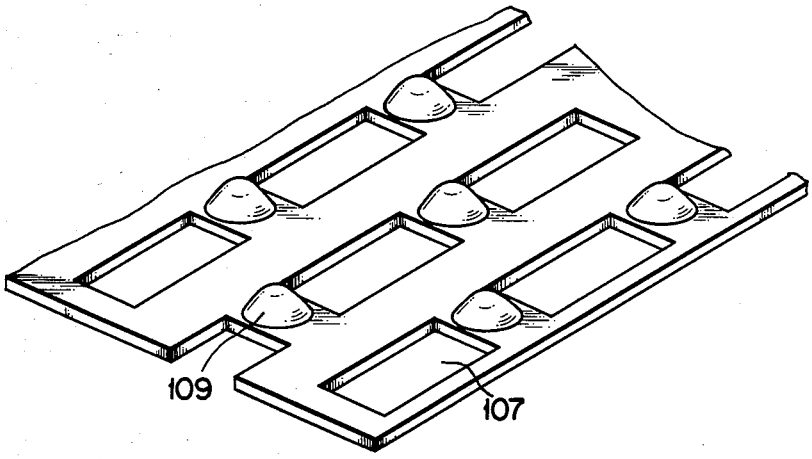
FIG. 7B is a fragmentary perspective view showing a further modification of projections formed on masks according to the invention.

For example, a small projection 108 may be formed adjacent to each aperture 107, as shown in FIG. 7A. Also, the shape of the projection is limited by no means, so they may be projections 109 formed by a press as shown in FIG. 7B. Where a mask having the structure as shown in FIG. 7A is used and disposed in the manner as shown in FIG. 2A, the main lines of electric force are substantially the same as those shown in FIG. 2A, and the same lens effect can be obtained.

In the case of FIG. 7B, the rows of apertures are arranged in a staggered fashion in one direction, and this arrangement is effective for coping with moire on the screen.

While in the above embodiment the mask 8, metal-backed screen 1 and conductive film 9 are held at a high anode potential while the mask 7 is held at a slightly lower potential, this is by no means limitative. It is possible, for instance, to hold the screen 1 and conductive coating 9 at the anode potential, hold the mask 8 at a potential slightly higher or slightly lower than the anode potential and hold the mask 7 at a potential slightly lower than the potential of the mask 8, as is obvious from the principles of the quadrupole lens.

Further, it is possible to interchange the masks 7 and 8 and their potentials.

Further, while in the above embodiment the apertures were rectangular in shape, the shape of the aperture is not essential to the invention, and any other suitable shape of aperture such as circular, oval and square shapes may be adopted.

In the following embodiments, the apertures are circular, but they may of course be of any other suitable shape as well.

While the embodiment shown in FIGS. 2A through 2C was of a two-mask structure in which the two shadow masks were formed on their facing sides with elongate or ridge-like projections extending adjacent to the apertures such that the projections of one mask cross those of the other mask, thus forming a quadrupole lens between two masks, this is by no means limitative, and in general the effect of the invention is obtainable so long as the lens action of the mask section is varied by providing at least one side of at least one of a plurality of masks with projections formed near the apertures.

Some other embodiments are shown below.

Figure 4:
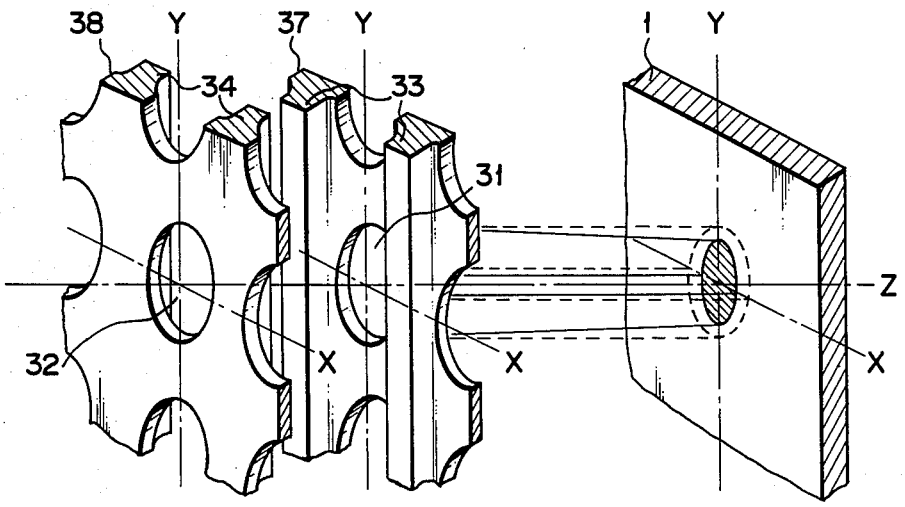
FIG. 4 is a fragmentary enlarged-scale perspective view showing a mask and screen structure in a different embodiment of the invention.

FIG. 4 shows a case, in which two shadow masks 37 and 38 are provided with projections 33 and 34 extending in the same directions. The apertures 31 locate between two adjacent projections 33 and the apertures 32 locate between two adjacent projections 34. In this case, a quadrupole lens as mentioned above is not formed, so that the focusing power in the mask section is weak compared to the case of the mask structure shown in FIG. 2A, but it is still strong compared to the case of the mask structure without any projection and thus permits reduction of the inter-mask potential difference compared to the prior art.

This is because of the fact that a sort of asymmetrical lens is formed by the two masks and screen. By the effect of projections, the focusing power in the X-Z plane is stronger than that in the Y-Z plane. Thus, compared to the mask without projections, strong focusing effect can be obtained in the X-Z plane to permit reduction of the inter-mask potential difference.

In this case, even if the mask 38 were a mask without the projections 34 and only the mask 37 has the projections 33, the same effects as described above can be obtained although to a less extent, and thus the inter-mask potential difference can be reduced compared to the case of a combination of masks without any projections.

Figure 5:
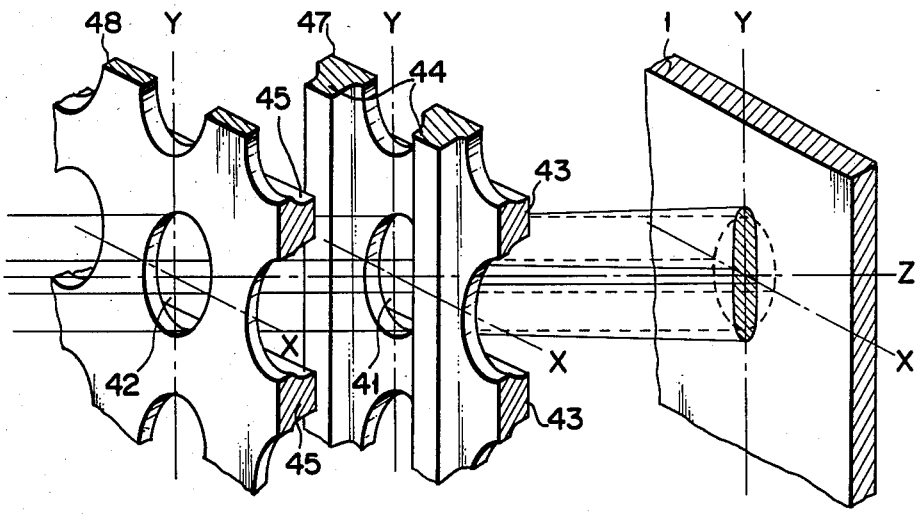
FIG. 5 is a fragmentary enlarged-scale perspective view showing a mask and screen structure in a further embodiment of the invention.

Projections may be provided on the both sides of a shadow mask as shown in FIG. 5. In the case of FIG. 5, the screen side mask 47 is provided on the side facing the mask 48 with elongate projections 44 extending between any two adjacent rows of apertures 41 in the vertical direction (Y axis direction) and is provided on the side facing the screen 1 with elongate projections 43 extending between any two adjacent rows of apertures 41 in the horizontal direction (X axis direction). The mask 48 is provided on the side facing the mask 47 with elongate projections 45 extending between any two adjacent rows of apertures 42 in the horizontal direction (X axis direction).

Such a mask can also be fabricated by bonding separately prepared elongate or strip-like metal plates to a mask, or it can be fabricated by etching.

In this case, while the status of electric field in the zone where the two shadow masks face each other is substantially the same as in the case of FIG. 2A, the status of electric field in the zone where the screen side mask 47 faces the screen 1 is different from that in the case of FIG. 2A.

More particularly, a quadrupole lens is formed in the zone where the two masks 47, 48 face each other, and a asymmetrical lens is formed between the mask 47 and screen.

It is to be understood that with the mask-focusing color picture tube using a plural mask structure according to the invention, in which at least one shadow mask is provided at least on one side with projections adjacent to or near apertures, the focusing lens action at least in one plane can be increased to reduce the inter-mask potential difference compared to the case without any projection without sacrifice in the mechanical strength and moldability of the conventional shadow mask.

Furthermore, the each mask of the present invention can be formed in self-supporting structure and accordingly can be supported only at the peripheral portion of the mask without any insulating material in the aperture region between the masks. Consequently the breakdown along the insulating material is extremely reduced because no insulating material is bombarded by the electron beams.

Figure 6:
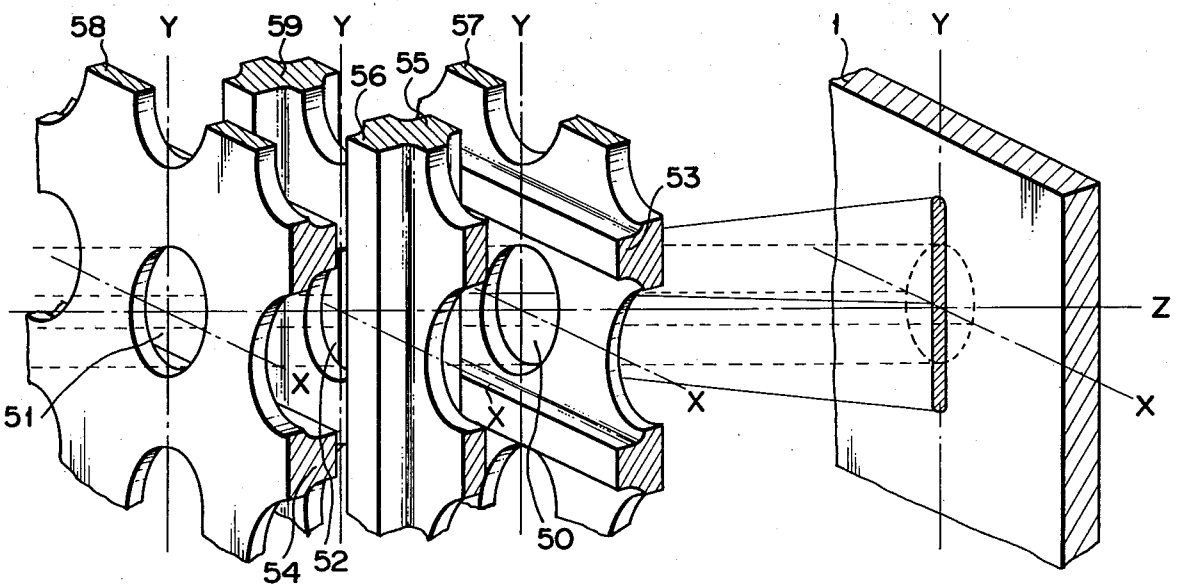
FIG. 6 is a fragmentary enlarged-scale perspective view showing a mask and screen structure in a still further embodiment of the invention.

Now, a further embodiment of the invention will be described. FIG. 6 shows a fragmentary enlarged-scale perspective view of a mask section and screen of a mask-focusing color picture tube using a three-mask structure embodying the invention. The other part of the arrangement of FIG. 6 than the mask section is the same as that of FIG. 1.

In the arrangement of FIG. 6, an intermediate shadow mask 59 is disposed between electron gun assembly side mask 58 and screen side mask 57. A highest anode voltage is applied to the masks 58 and 57 as well as to the screen 1, and a lower voltage is applied to the intermediate mask 59.

The electron gun side mask 58 and screen side mask 57 are provided on their sides facing the intermediate mask 59 with respective projections 54 and 53 extending between any two adjacent rows of apertures 51 and 50 in the horizontal direction (X axis direction), and the intermediate mask 59 is provided on the both sides with projections 55 and 56 extending between any two adjacent rows of apertures 52 in the vertical direction (Y axis direction).

With this mask structure, a quadrupole lens is formed between the electron gun side mask 58 and intermediate mask 59 and another quadrupole lens is formed between the intermediate mask 59 and screen side mask 57 by the same mechanism as described earlier in connection with FIG. 2A, so that a considerably strong lens action can be obtained.

For this reason, the voltage applied to the intermediate mask 59 may be slightly lower than the anode voltage applied to the masks 58 and 57 and screen 1. Thus, it is possible to further reduce the intermask potential difference compared to the case of the two-mask structure shown in FIG. 2A and provide a mask-focusing color picture tube excellent in the breakdown voltage.

While the foregoing embodiments concerned with mask-focusing color picture tubes adopting two-mask and three-mask structures, the same principles of the invention may also be applied to mask-focusing color picture tubes adopting other multiple mask structures.

What we claim is:

1. A mask-focusing color picture tube comprising:

means for generating a plurality of electron beams;

a substantially planar display screen comprising a plurality of phosphor stripes aligned parallel to one another with select ones of said stripes luminscing in a different color than others of said stripes upon being struck by one of said electron beams;

electrostatic lens means for focusing said beams onto said screen comprising first and second substantially planar masks, each mask having a plurality of apertures therein with each aperture being bounded on one pair of opposite edges by row portions of said mask and on another pair of opposite edges by column portions of said mask, each mask positioned parallel to the other and to the plane of said screen with said masks located between said screen and said means for generating, with said apertures of said masks aligned to permit said beams each to strike a respective stripe which luminesces in a different color, and each mask being at a different electrical potential than the other; and means for enhancing said focusing of said electrostatic lens means comprising a plurality of projections arranged on one side of at least one of said masks, said projections being arranged adjacent said apertures of said one side of said mask adjacent only one of said pairs of opposite edges of each aperture to arrange lines of electrical force through said apertures, upon application of said different electrical potential to said masks, in a manner which tends to diverge a beam through said apertures of said masks in a direction within the plane of said screen parallel to said stripes.

2. A mask of claim 1 wherein said projections are arranged on one side of both of said masks.

3. A mask of claim 2 wherein said projections are arranged on the sides of said masks which face each other.

4. A mask of claim 3 wherein said projections are continuous in a linear direction between said apertures.

5. A mask of claim 4 wherein said linear direction of said projections on said one of said masks is perpendicular to the linear direction of said projections on the other of said masks.

6. A mask of claim 4 wherein said linear direction of said projections on said one of said masks is parallel to the linear direction of said projections on the other of said masks.

7. A mask of claim 1 wherein said projections are independently disposed along said row portions.

8. A mask of claim 1 wherein said projections are arranged on both sides of one of said masks.

9. A mask of claim 7 wherein said projections on said one side of said mask are arranged adjacent said pairs of opposite edges bounded by said row portions and said projections on the other side of said at least one mask are arranged adjacent said pair of oppbsite edges bounded by said column portions.

10. A mask of claim 1 wherein said apertures are round in shape.

11. A mask of claim 1 wherein said apertures are rectangular in shape.

* * * * *